US008403524B2

(12) United States Patent
Prosey

(10) Patent No.: US 8,403,524 B2
(45) **Date of Patent: *Mar. 26, 2013**

(54) LIGHTING SYSTEM FOR VEHICLE MAINTENANCE PLATFORM

(76) Inventor: Joseph Prosey, Benton, PA (US)

( * ) Notice: Subject to any disclaimer, the term of this patent is extended or adjusted under 35 U.S.C. 154(b) by 508 days.

This patent is subject to a terminal disclaimer.

(21) Appl. No.: 12/559,534

(22) Filed: Sep. 15, 2009

(65) Prior Publication Data

US 2010/0079985 A1 Apr. 1, 2010

Related U.S. Application Data

(60) Provisional application No. 61/194,911, filed on Oct. 1, 2008.

(51) Int. Cl.
*F21V 33/00* (2006.01)

(52) U.S. Cl. ..... 362/234; 362/183; 280/32.6

(58) Field of Classification Search ..... 362/183, 362/234; 280/32.6

See application file for complete search history.

(56) References Cited

U.S. PATENT DOCUMENTS

| | | | | |
|---|---|---|---|---|
| 2,291,094 | A * | 7/1942 | McCarthy | 362/459 |
| 4,698,731 | A * | 10/1987 | Johns, Sr. | 362/486 |
| 4,986,558 | A * | 1/1991 | Morris | 280/32.6 |
| 5,494,305 | A * | 2/1996 | Chen | 280/32.6 |
| 6,238,069 | B1 * | 5/2001 | Miles | 362/486 |
| 7,032,907 | B1 | 4/2006 | Marsh | |
| 7,032,908 | B2 * | 4/2006 | Melvin | 280/32.6 |
| 7,815,356 | B2 * | 10/2010 | Lutz et al. | 362/577 |
| 2002/0109991 | A1 * | 8/2002 | Alsup | 362/253 |
| 2006/0028819 | A1 * | 2/2006 | Shankland et al. | 362/253 |

* cited by examiner

*Primary Examiner* — Mary McManmon
(74) *Attorney, Agent, or Firm* — Aidenbaum Schloff and Bloom PLLC; Jay Schloff

(57) ABSTRACT

A lighting system for a vehicle maintenance platform includes a frame structure, a plurality of light sources and a rechargeable power source. The frame structure is capable of being detachably coupled to the vehicle maintenance platform. The plurality of light sources is disposed on the frame structure and is configured to illuminate a target region underneath a vehicle. The rechargeable power source is coupled to the frame structure and is electrically connected to the plurality of light sources. The rechargeable power source provides electrical power to the plurality of light sources. Further, a vehicle maintenance apparatus including the lighting system and the vehicle maintenance platform is also provided.

18 Claims, 5 Drawing Sheets

LIGHTING SYSTEM FOR VEHICLE MAINTENANCE PLATFORM

CROSS REFERENCE TO RELATED APPLICATIONS

The present disclosure claims priority under 35 United States Code, Section 119 on the U.S. Provisional Patent Application No. 61/194,911 filed on Oct. 1, 2008, the disclosure of which is incorporated by reference.

FIELD OF THE DISCLOSURE

The present disclosure relates generally to lighting systems, and more particularly, to a lighting system for vehicle maintenance platforms that are utilized for maintenance activities underneath vehicles.

BACKGROUND OF THE DISCLOSURE

It is common for a vehicle mechanic to use a vehicle maintenance platform (hereinafter referred to as 'platform') for performing various maintenance activities underneath a vehicle. For example, the vehicle mechanic (hereinafter referred to as 'mechanic') may utilize the platform, such as a creeper, to access a bottom portion of the vehicle to perform various maintenance activities by sliding/rolling the platform underneath the vehicle. Generally, the platform includes a body support platform to support mechanic's body and a wheel assembly for facilitating movement of the platform from one place to another. The mechanic may lie on the body support platform and roll under the vehicle using the wheel assembly of the platform, while the vehicle is held at a particular height above the ground level using a hydraulic lift, a mechanical jack, and the like.

Generally, while the mechanic is positioned underneath the vehicle, there is lack of ample light required for the mechanic to properly see the bottom portion (i.e., the underside) of the vehicle. This is primarily due to the fact that various components of the vehicle and the mechanic's body may block the light coming from a light source, such as garage lighting. Such blockage may cause a dimly lit region to be formed in the bottom portion of the vehicle, thereby causing inconvenience to the mechanic while performing the maintenance activities.

Currently, there are a few techniques known in the art for addressing the above problem of insufficient light in the bottom portion of the vehicle. In one such technique, the mechanic utilizes a portable light source. Typically, the mechanic positions the portable light source near the platform such that the portable light source illuminates the bottom portion of the vehicle. In some cases, the mechanic holds the portable light source in his/her hand at a desired position, or he/she may keep it on the ground near the platform. Alternatively, the mechanic may also hang the portable light source upon any suitable component of the bottom portion of the vehicle by using a hook (or other fastener) incorporated on the light source or an electrical cord that is utilized to provide electrical power to the portable light source from a conventional wall socket. The electrical cord is connected at one end to the portable light source and to the wall socket at other end, for providing electrical power to the portable light source from the conventional wall socket.

Such a portable light source has various drawbacks associated therewith. For example, the portable light source requires a connection to the conventional wall socket for obtaining electrical power to power itself. However, sometimes an electrical outlet such as the conventional wall socket is not easily accessible or not available at all near the vehicle. In such cases, it becomes very cumbersome for the mechanic to perform the maintenance activities in the bottom portion of the vehicle. Further, it is inconvenient for the mechanic to hold the portable light source in his/her hand while performing the maintenance activities. Furthermore, holding the portable light source with one hand may be tiresome and also reduces the efficiency of the mechanic as he/she has to perform the maintenance activities with one hand only. Further, when the mechanic keeps the portable light on the ground, the electrical cord and the portable light itself causes obstructions in movement of the platform. Particularly, the electrical cord and the portable light cause obstructions in the rolling of the wheels of the platform.

SUMMARY

In view of the foregoing disadvantages inherent in the prior art, the general purpose of the present disclosure is to provide a lighting system for a vehicle maintenance platform, configured to include all the advantages of the prior art, and to overcome the drawbacks inherent therein.

Accordingly, an object of the present disclosure is to provide a lighting system for a vehicle maintenance platform, where the lighting system avoids any electrical power requirement from an external wall socket.

Another object of the present disclosure is to provide a lighting system for a vehicle maintenance platform that is convenient to a mechanic in performing maintenance activities underneath a vehicle.

Yet another object of the present disclosure is to provide a lighting system for a maintenance platform that may be conveniently moved from one place to another without undue obstructions.

In light of the above objects, in one aspect of the present disclosure, a lighting system for a vehicle maintenance platform is provided. The lighting system includes a frame structure, a plurality of light sources and a rechargeable power source. The frame structure is capable of being detachably coupled to the vehicle maintenance platform. The plurality of light sources is disposed on the frame structure. The plurality of light sources is configured to illuminate a target region underneath the vehicle. The rechargeable power source is positioned on the frame structure. The rechargeable power source powers the plurality of light sources. The plurality of light source is capable of emitting light to illuminate the target region underneath the vehicle while the maintenance activities.

In another aspect of the present disclosure, a vehicle maintenance apparatus is disclosed. The vehicle maintenance apparatus includes a vehicle maintenance platform and a lighting system. The vehicle maintenance platform includes a support structure, a plurality of wheels and a body support member. The lighting system includes a frame structure, a plurality of light sources and a rechargeable power source. The plurality of wheels is attached to the support structure. The plurality of wheels is configured to facilitate rolling of the support structure. The body support member is positioned on the support structure. The body support member is configured to support a mechanic's body thereon. The frame structure is capable of being detachably coupled with the support structure. The plurality of light sources is disposed on the frame structure. The plurality of light sources is configured to illuminate a target region underneath a vehicle. Further, the rechargeable power source is coupled to the frame structure. The rechargeable power source is electrically connected to the plurality of light sources. The rechargeable power source powers the plurality of light sources. The plurality of light source is capable of emitting light to illuminate the target region underneath the vehicle while the maintenance activities.

These together with other aspects of the present disclosure, along with the various features of novelty that characterize the present disclosure, is pointed out with particularity in the claims annexed hereto and forms a part of this present disclosure. For a better understanding of the present disclosure, its operating advantages, and the specific objects attained by its uses, reference should be made to the accompanying drawing and descriptive matter in which there are illustrated exemplary embodiments of the present disclosure.

BRIEF DESCRIPTION OF THE DRAWINGS

The advantages and features of the present disclosure will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DISCLOSURE

The exemplary embodiments described herein detail for illustrative purposes are subject to many variations in composition, structure, and design. It should be emphasized, however, that the present disclosure is not limited to a particular lighting system for a maintenance platform and a vehicle maintenance apparatus, as shown and described. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

Unless limited otherwise, the terms "coupled," "attached," and variations thereof herein are used broadly and encompass direct and indirect arrangements. The terms "a" and "an" herein do not denote a limitation of quantity, but rather denote the presence of at least one of the referenced items.

The present disclosure provides a lighting system to be utilized with a vehicle maintenance platform. Examples of the vehicle maintenance platform may include, but are not limited, a creeper and a trolley. The lighting system is capable of being removably coupled to the vehicle maintenance platform. The lighting system has a plurality of light sources that illuminate a target region underneath a vehicle. The plurality of light sources of the lighting system is powered by a rechargeable power source.

Figure 1A:
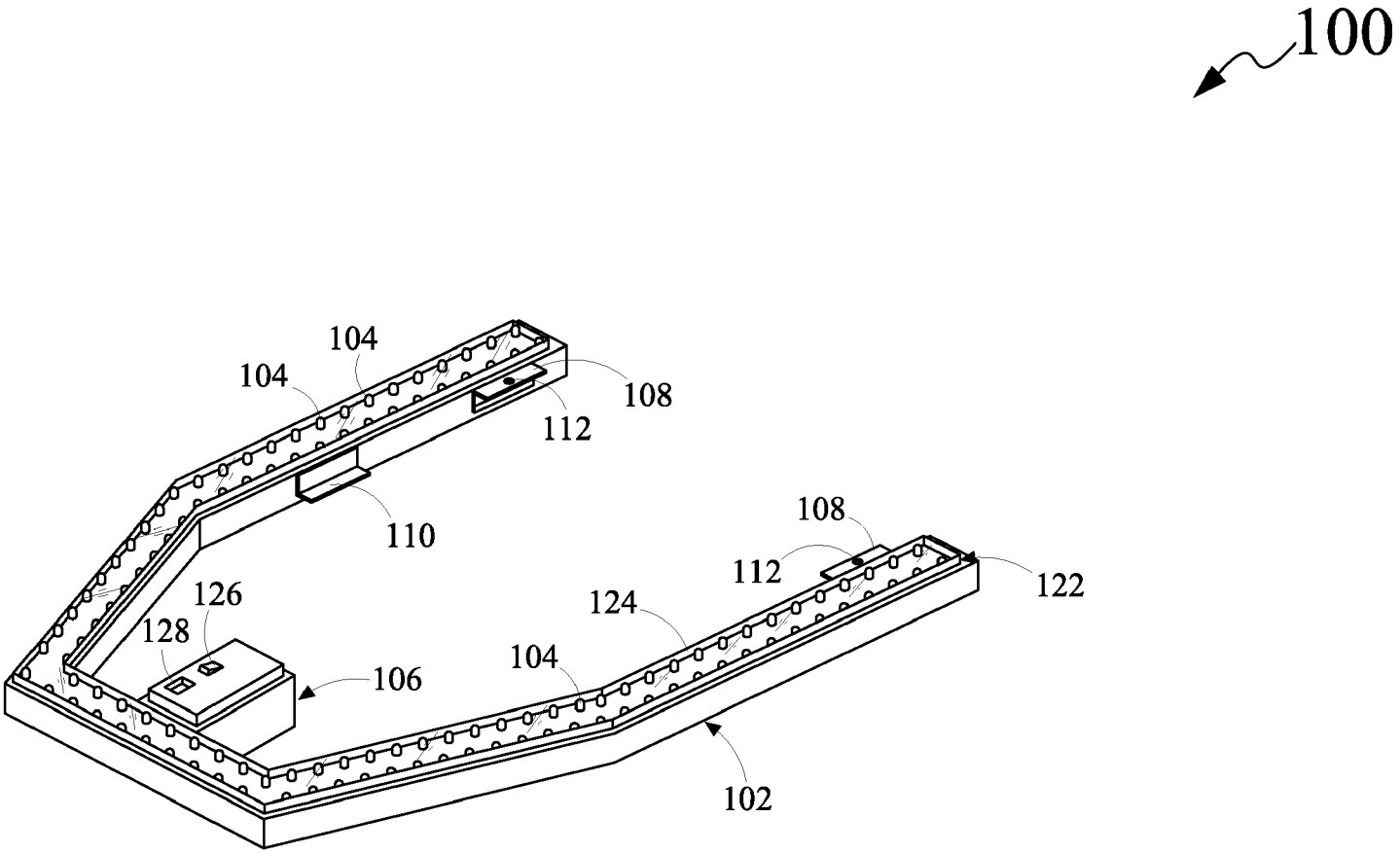
FIG. 1A illustrates a perspective view of a lighting system for a vehicle maintenance platform, in accordance with one embodiment of the present disclosure.
Figure 1B:
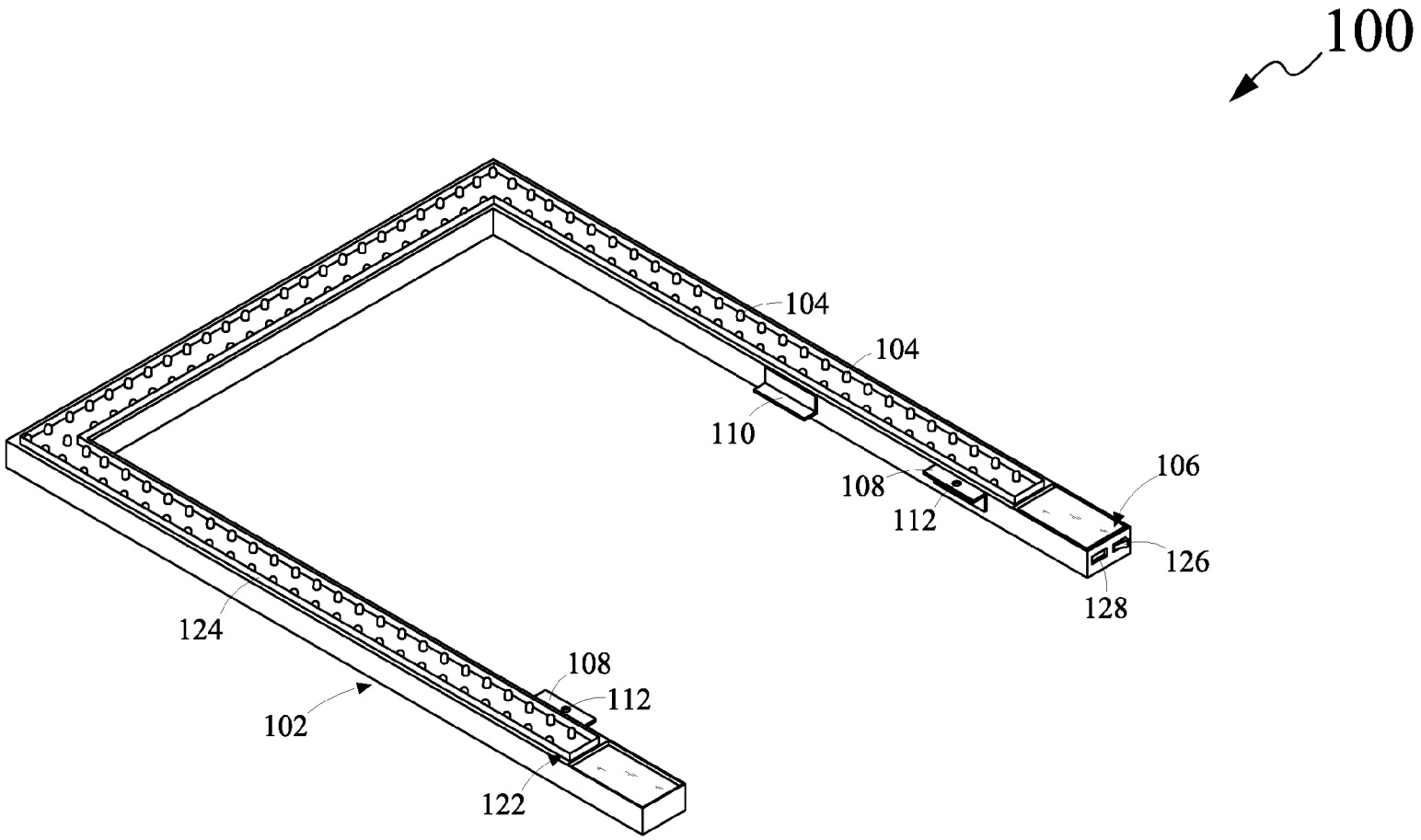
FIG. 1B illustrates a perspective view of the lighting system for the vehicle maintenance platform, in accordance with another embodiment of the present disclosure.
Figure 2:
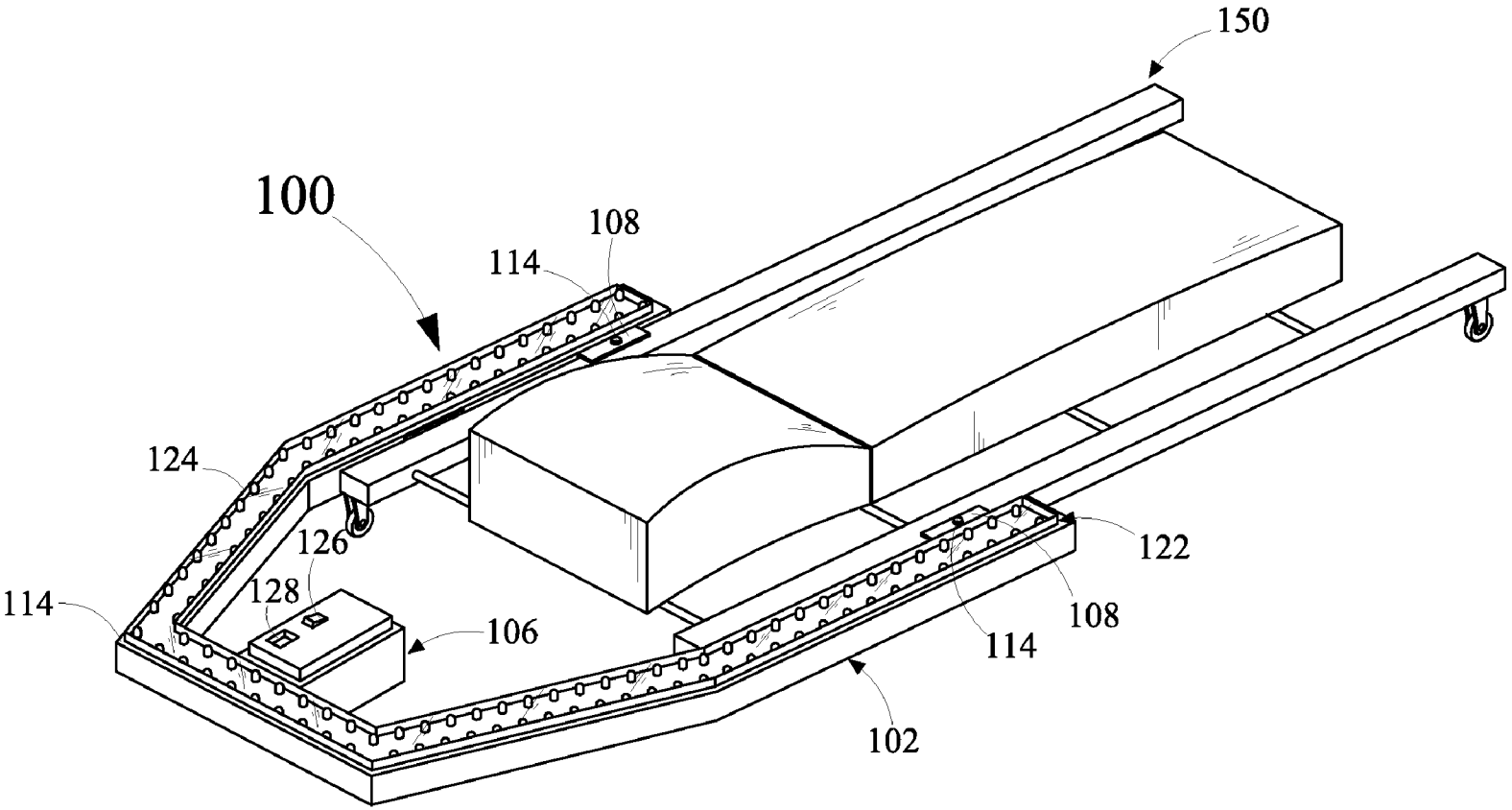
FIG. 2 illustrates a perspective view depicting attachment of the lighting system with the vehicle maintenance platform, in accordance with one embodiment of the present disclosure.

Referring to FIGS. 1A and 1B, perspective views of a lighting system 100 for a vehicle maintenance platform according to different embodiments of the present disclosure, and referring to FIG. 2 a perspective view of the lighting system 100 integrated with the vehicle maintenance platform, are shown.

The lighting system 100 includes a frame structure 102, a plurality of light sources 104, and a rechargeable power source 106 (hereinafter referred to as 'power source 106'). The frame structure 102 is capable of being detachably coupled to the vehicle maintenance platform such as a vehicle maintenance platform 150 (depicted in FIG. 2). The light sources 104 are disposed on the frame structure 102. The light sources 104 are configured to illuminate a target region underneath a vehicle. The power source 106 is coupled to the frame structure 102 and is electrically connected to the light sources 104. The power source 106 provides electrical powers to the light sources 104.

The frame structure 102 of the lighting system 100 is capable of being detachably coupled to the vehicle maintenance platform 150 (hereinafter referred to as 'maintenance platform 150') through a coupling mechanism. In one embodiment of the present disclosure, the coupling mechanism may include one or more coupling brackets, such as mounting brackets 108 and a support bracket 110. The mounting brackets 108 are disposed on the frame structure 102. The mounting brackets 108 include holes 112 formed thereon. The maintenance platform 150 may further be aligned with respect to the lighting system 100 and bolts 114*a*, 114*b* may be inserted in holes 112, respectively to couple the lighting system 100 with the maintenance platform 150. In one embodiment of the present disclosure, nuts (not shown) corresponding to the bolts 114*a*, 114*b* maybe screwed at respective other ends of the bolts 114*a*, 114*b*, thereby securing the lighting system 100 and the maintenance platform 150 together. The support bracket 110 is attached to a bottom portion of the frame structure 102 and is configured to support the maintenance platform 150, when the maintenance platform 150 is coupled to the lighting system 100. However, it may be apparent to a person skilled in the art that various other coupling mechanisms may be utilized for coupling the lighting system 100 to the maintenance platform 150, apart from utilizing the mounting brackets 108 and support bracket 110.

Further, the light sources 104 are disposed on the frame structure 102 in a serial manner. The light sources 104 are configured to illuminate the target region underneath the vehicle, which will be further described in conjunction with FIG. 3. The light sources 104 are arranged such that light emitted from the light sources 104 is projected towards the target region. In one embodiment of the present disclosure, to enhance focus of the projection of the light emitted from the light sources 104, the lighting system 100 includes a lens arrangement 122 disposed over the light sources 104. The lens arrangement 122 focuses the light emitted from the light sources 104 onto the target region. The lens arrangement 122 includes a sheet 124 composed of at least one of a plastic material and a glass material, which is configured to focus the light emitted from the light sources 124 onto the target region. It would be apparent to a person skilled in the art that the sheet 124 may be composed of various other light transparent materials that focuses the light emitted from the light sources 104 onto the target region. The inclusion of the lens arrangement 122 reduces luminance requirement of the light sources 104. This enables the lighting system 100 to include light sources 104 with has relatively low luminance capacity, which in turn helps in minimizing the power requirement of the light sources 104.

In one embodiment of the present disclosure, the light sources 104 may be Light Emitting Diodes (LEDs). An LED is a preferred choice for a light source 104, as LED consumes comparatively less electrical energy as compared to other light sources. This effectively reduces electrical power requirement of the power source 106 of the lighting system 100. However, it may be apparent to a person skilled in the art that various other light sources may be utilized as the light sources 104. The light sources 104 are supplied with the electrical power from the power source 106.

In an embodiment, the power source 106 is coupled to a top portion of the frame structure 102 (as depicted in FIG. 1A). In another embodiment, the power source 106 is housed within the frame structure 102. Specifically, the power source 106 is housed within a bottom portion of the frame structure 102 (as depicted in FIG. 1B). However, it may be apparent to a person skilled in the art that the power source 106 may be coupled/housed at various other positions of the frame structure 102. The power source 106 is electrically connected to the light sources 104 through an internal wiring (not shown). The power source 106 supplies the electrical power to the light sources 104 so that the light sources 104 emit the light for illuminating the target region. Further, lighting system 100 includes an electrical switch 126 configured to activate/deactivate the light sources 104. Specifically, when the electrical switch 126 is in an 'ON' state, the power source 106 and light sources 104 are electrically connected and the light sources 104 are powered on. Further, when the electrical switch 126 is in an 'OFF' state, the power source 106 and the light sources 104 are disconnected, thereby powering-off the light sources 104.

Examples of the power source 106 may include, but are not limited to, a Nickel Cadmium (NiCd) Battery, a Nickel-Metal Hydride (NiMH) Battery, a Lithium-ion Battery. In one embodiment of the present disclosure, the power source 106 may have a voltage of about 9.6 volts. However, it may be apparent to a person skilled in the art that batteries with different voltage may also be utilized as the power source 106. Further, the power source 106 may be recharged to a desired voltage level when required. The power source 106 may be connected to an external power source such as a wall socket through a power supply port 128, for charging to the power source 106 to the desired voltage level. In an embodiment where the power source 106 is contained within the frame structure 102, the frame structure 102 may include a requisite aperture to permit the power source 106 and power supply port 128 to connect to the external power supply.

As disclosed above, the frame structure 102 of the lighting system 100 is configured to be detachably coupled to the maintenance platform 150. Particularly, the frame structure 102 of the lighting system 100 may be detachably coupled to a conventional maintenance platform having a width of about 17 inches. Accordingly, in one embodiment of the present disclosure, the frame structure 102 may have a length of about 32 inches and a breadth of about 21 inches. The frame structure 102 shown in the embodiment of FIG. 1A is formed in a bent shape which circumscribes a portion of the maintenance platform 150 (as depicted in FIG. 2). Of course, in another embodiment of the present disclosure, the frame structure 102 is also formed in an open-ended rectangular configuration (as depicted in FIG. 1B). The frame structure 102 disclosed in this embodiment may also circumscribe a portion of the maintenance platform 150 similar to the frame structure 102 of previous embodiment. However, the frame structure 102 may have other shapes as depending upon the shape of the maintenance platform 150, such that the frame structure 102 and the maintenance platform 150 may be properly connected. Usage of the lighting system 100 with the maintenance platform 150 is further described in conjunction with FIG. 3.

Figure 3:
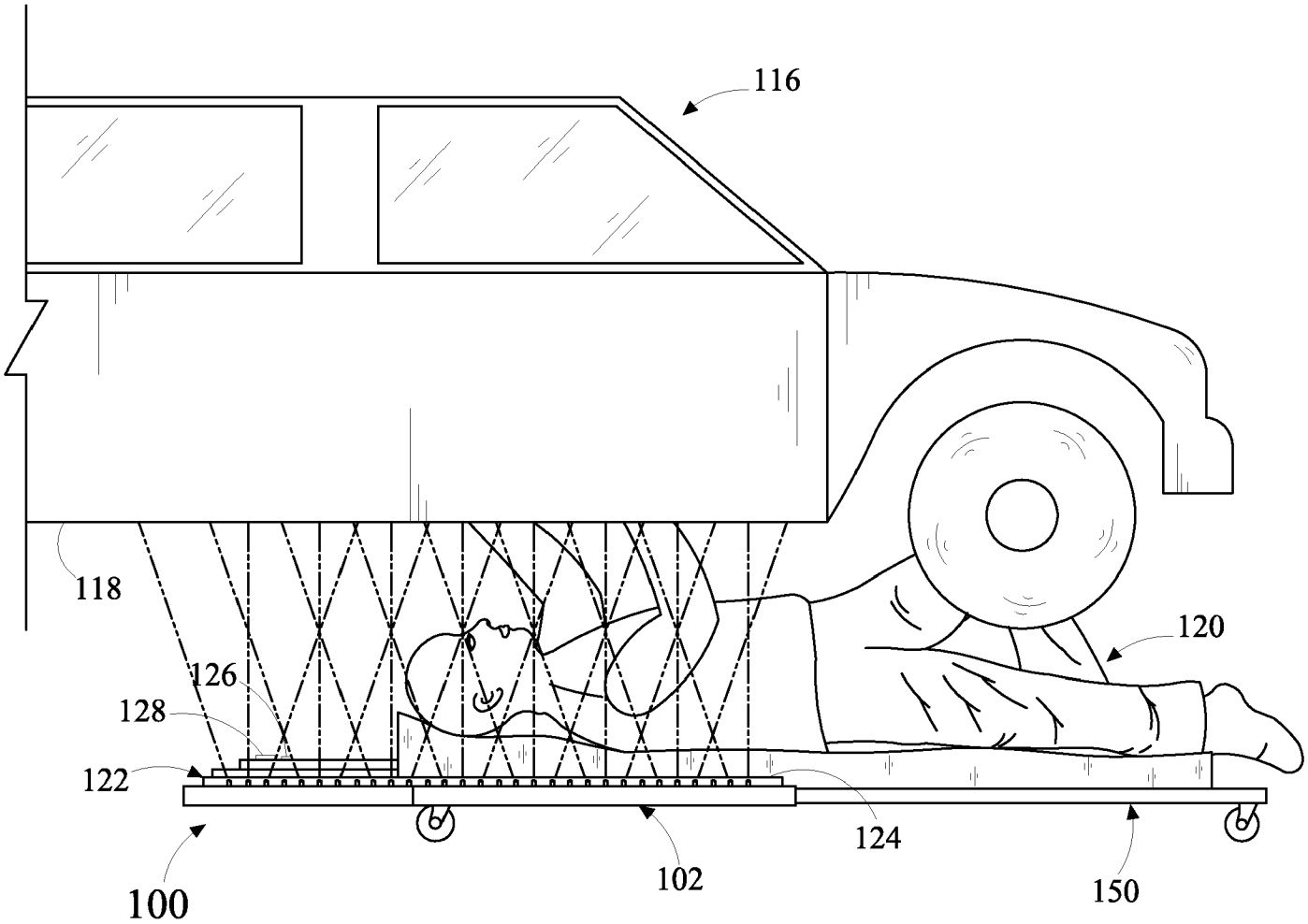
FIG. 3 illustrates an environment depicting utilization of the lighting system for a maintenance activity underneath a vehicle, in accordance with one embodiment of the present disclosure.

Referring now to FIG. 3, an environment depicting usage of the lighting system 100 is illustrated, in accordance with one embodiment of the present disclosure. The lighting system 100 integrated with the maintenance platform 150 may be slid by a mechanic 120 underneath a vehicle 116. More specifically, the lighting system 100 integrated with the maintenance platform 150 may be slid close to a target region in a bottom portion 118 of the vehicle 116, where maintenance is required. The light sources 104 of the lighting system 100 may be utilized to illuminate the target region of the bottom portion 118. The illumination of the target region facilitates the mechanic 120 to perform various maintenance activities thereon. In another embodiment, the present disclosure also provides the lighting system 100 and the maintenance platform 150 as a single unit, which is further described in conjunction with FIG. 4.

Figure 4:
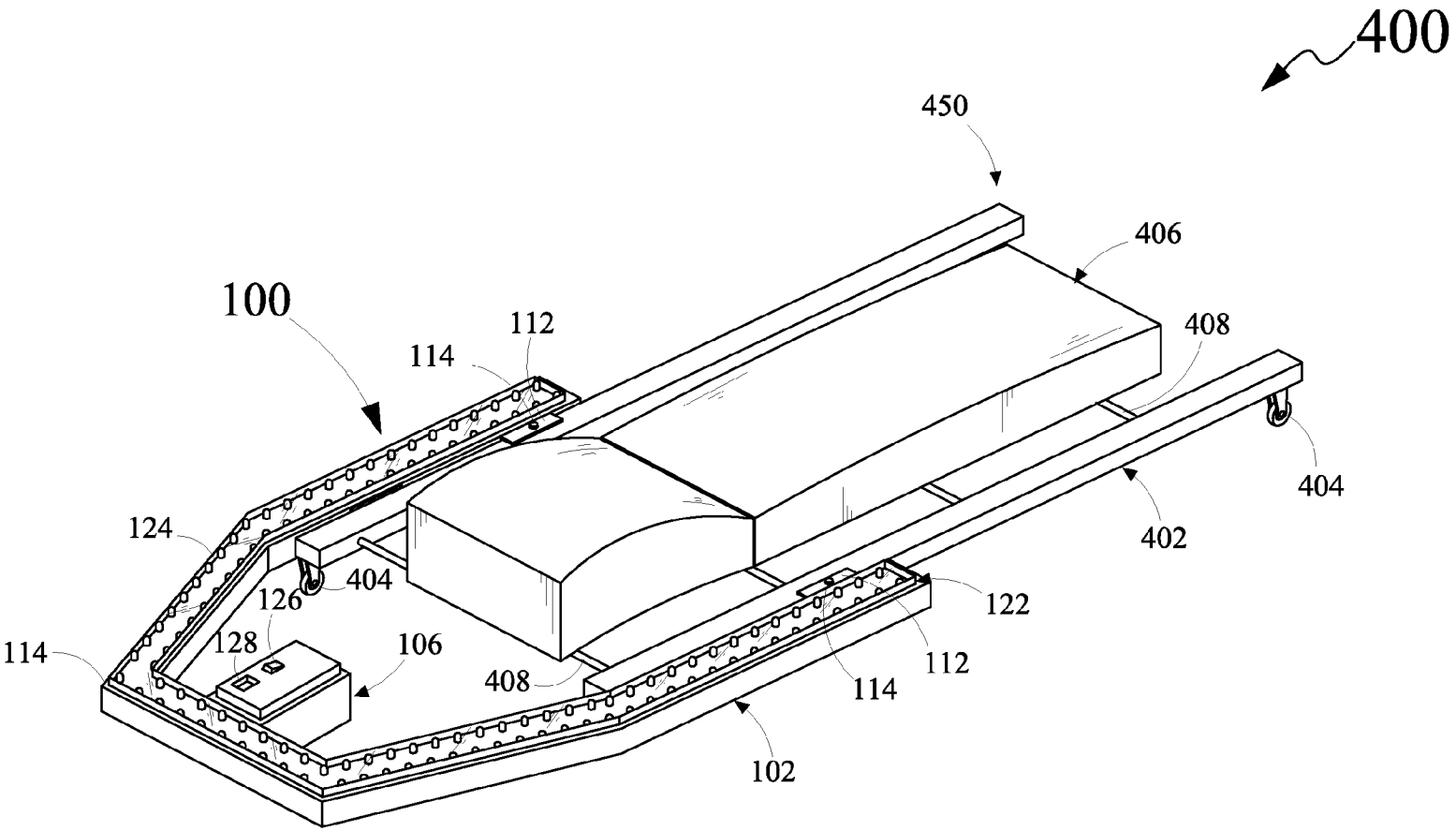
FIG. 4 illustrates a perspective view of a vehicle maintenance apparatus, in accordance with another embodiment of the present disclosure.

Referring now to FIG. 4, a vehicle maintenance apparatus 400 is shown, in accordance with another embodiment of the present disclosure. The vehicle maintenance apparatus 400 includes a vehicle maintenance platform 450 and a lighting system, such as the lighting system 100 coupled with the vehicle maintenance platform 450. The vehicle maintenance platform 450 includes a support structure 402, a plurality of wheels such as wheels 404 and a body support member 406 positioned on the support structure 402. The lighting system 100 is already described above in conjunction with FIGS. 1 and 2. In the embodiment shown in FIG. 4, the frame structure 102 of the lighting system 100 may be coupled to the support structure 402 of the vehicle maintenance platform 450 through the coupling mechanism such as mounting brackets 108 and the support brackets 110. However, it would be apparent to those skilled in that art that the lighting system 100 may also be permanently coupled to the vehicle maintenance platform 450.

Further, the wheels 404 are coupled to a bottom portion of the support structure 402. The wheels 404 are configured to facilitate rolling of the support structure 402 on a surface such as the ground, thereby enabling movement of the vehicle maintenance apparatus 400 on the ground. Further, the body support member 406 is deposed on the support structure 402. More specifically, the body support member 406 may be disposed on a plurality of elongated rods 408 of the support structure 402. The body support member 406 is configured such that the mechanic 120 may lie thereon, while performing various maintenance activities in the bottom portion 118 of the vehicle 116.

A lighting system, such as the lighting system 100 and a vehicle maintenance apparatus such as the vehicle maintenance apparatus 400 are advantageous in illuminating a region, such as a bottom portion of a vehicle. The lighting system 100 does not require electrical power from an external wall socket to operate. The lighting system generates the electrical power on-board. This enables the lighting system 100 to be utilized in places with having limited or no access to external electrical ports, such as a driveway or a junkyard. Furthermore, the lighting system 100 increases the efficiency of the mechanic while providing convenience in performing maintenance activities. The lighting system 100 is especially useful a mechanic who often needs to access the bottom portion of the vehicle for various maintenance activities. Specifically, the vehicle maintenance apparatus 400 includes the body support member 406 for supporting the mechanic's body. Moreover, the vehicle maintenance apparatus 400 includes the wheels 404 that enable easy movement of the vehicle maintenance apparatus 400.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present disclosure.

What is claimed is:

1. A lighting system for a vehicle maintenance platform, the vehicle maintenance platform useable for maintenance activities underneath a vehicle, wherein the vehicle maintenance platform comprises:

a support structure, the support structure having at least three sides, a plurality of wheels attached to the support structure for rolling the support structure on a surface, and a body support member disposed on the support structure to allow a mechanic to lie thereon, and wherein the lighting system comprises:

a frame structure capable of being detachably coupled to the vehicle maintenance platform, said frame structure of said lighting system comprising at least three walls, the walls forming a continuous channel that extends along the entire frame structure, a plurality of light sources disposed in the channel, the plurality of light sources arranged in at least three linear arrays the frame structure being bent in at least two locations along the entire frame structure such that at least three of the at least three sides of the support structure have a linear array disposed adjacent thereto, the plurality of light sources configured to illuminate a target region underneath the vehicle;

a rechargeable power source electrically connected to the plurality of light sources, the rechargeable power source capable of providing electrical power to the plurality of light sources, wherein the plurality of light source is capable of emitting light to illuminate a target region underneath the vehicle while the maintenance activities; and a lens arrangement disposed over the channel, wherein the lens arrangement is configured to focus light emitted from the plurality of light sources onto the target region.

2. The lighting system of claim 1, wherein the lens arrangement comprises a sheet composed of at least one of a plastic material and a glass material.

3. The lighting system of claim 1, further comprising an electrical switch configured to control supply of the electrical power from the rechargeable power source to the plurality of light sources.

4. The lighting system of claim 1, further comprising a power supply port configured to charge the rechargeable power source from an external power source.

5. The lighting system of claim 1, further comprising a coupling mechanism disposed on the frame structure for coupling the frame structure to the vehicle maintenance platform.

6. The lighting system of claim 5, wherein the coupling mechanism comprises one or more coupling brackets.

7. The lighting system of claim 5, wherein the coupling mechanism comprises a nut-and-bolt arrangement.

8. The lighting system of claim 1, wherein the plurality of light sources are Light Emitting Diodes (LED).

9. The lighting system of claim 1, wherein the rechargeable power source is coupled to the frame structure.

10. The lighting system of claim 1, wherein the rechargeable power source is housed within the frame structure.

11. A vehicle maintenance apparatus, comprising:

a vehicle maintenance platform comprising a support structure, the support structure having at least three sides, a plurality of wheels attached to the support structure for rolling the support structure on a surface, and a body support member disposed on the support structure to allow a mechanic to lie thereon; and a lighting system operatively coupled to the vehicle maintenance platform, the lighting system comprising a frame structure capable of being detachably coupled to the support structure of the vehicle maintenance platform, said frame structure of said lighting system comprising at least three walls, the walls forming a continuous channel that extends along the entire frame structure, a plurality of light sources disposed in the channel, the plurality of light sources arranged in at least three linear arrays, at least three of the at least three sides of the frame structure have a linear array disposed directly adjacent thereto, the plurality of light sources configured to illuminate a target region underneath the vehicle, and a rechargeable power source electrically connected to the plurality of light sources, the rechargeable power source capable of providing electrical power to the plurality of light sources, wherein the plurality of light sources is capable of emitting light to illuminate a target region underneath the vehicle while maintenance activities thereof, and a lens arrangement disposed over the channel, wherein the lens arrangement is configured to focus light emitted from the plurality of light sources onto the target region.

12. The vehicle maintenance apparatus of claim 11, wherein the lens arrangement comprises a sheet composed of at least one of a plastic material and a glass material.

13. The vehicle maintenance apparatus of claim 11, further comprising an electrical switch configured to control supply of the electrical power from the rechargeable power source to the plurality of light sources.

14. The vehicle maintenance apparatus of claim 11, wherein the vehicle maintenance platform further comprises a power supply port configured to charge the rechargeable power source from an external power source.

15. The vehicle maintenance apparatus of claim 11, further comprising a coupling mechanism disposed on the frame structure for coupling the frame structure to the support structure of the vehicle maintenance platform.

16. The vehicle maintenance apparatus of claim 15, wherein the coupling mechanism comprises one or more coupling brackets.

17. The vehicle maintenance apparatus of claim 15, wherein the coupling mechanism comprises a nut-and-bolt arrangement.

18. The vehicle maintenance apparatus of claim 11, wherein the plurality of light sources are Light Emitting Diodes (LED).

* * * * *